US007603801B2

(12) United States Patent
Jiang et al.

(10) Patent No.: US 7,603,801 B2
(45) Date of Patent: Oct. 20, 2009

(54) DEVICE FOR DE-WRINKLING GARMENTS

(75) Inventors: Yong Jiang, Groningen (NL); Mohankumar Valiyambath Krishnan, Singapore (SG); Boon Khian Ching, Singapore (SG); Tao Guo, Perth (AU); Vidya Sagar Gannamani, Hilversum (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 29 days.

(21) Appl. No.: 10/579,023

(22) PCT Filed: Nov. 4, 2004

(86) PCT No.: PCT/IB2004/052307

§ 371 (c)(1),
(2), (4) Date: Apr. 23, 2007

(87) PCT Pub. No.: WO2005/045121

PCT Pub. Date: May 19, 2005

(65) Prior Publication Data

US 2007/0214689 A1 Sep. 20, 2007

(30) Foreign Application Priority Data

Nov. 11, 2003 (EP) ..... 03104153

(51) Int. Cl.
*D06F 58/10* (2006.01)
*D06F 71/34* (2006.01)

(52) U.S. Cl. ..... 38/104; 38/75; 38/96

(58) Field of Classification Search ..... 38/1 R, 38/2, 3, 7, 14, 63, 64, 66, 1 A, 1 C, 1 D, 75, 38/104, 111; 223/66–74; 34/622; 68/13 R, 68/5 C See application file for complete search history.

(56) References Cited

U.S. PATENT DOCUMENTS

| | | | | |
|---|---|---|---|---|
| 2,785,557 | A * | 3/1957 | Stilwell, Jr. | 68/12.15 |
| 3,432,939 | A * | 3/1969 | Eichholz | 34/622 |
| 3,471,067 | A * | 10/1969 | Stewart | 223/57 |
| 3,576,079 | A | 4/1971 | Hauser | |
| 3,805,561 | A * | 4/1974 | Bullock | 68/5 C |
| 4,274,214 | A * | 6/1981 | Hauser | 38/1 C |

(Continued)

FOREIGN PATENT DOCUMENTS

| | | |
|---|---|---|
| EP | 0 122 569 | 10/1984 |

(Continued)

*Primary Examiner*—Ismael Izaguirre

(57) ABSTRACT

A garment de-wrinkling device (1) comprises an enclosure (10) for moistening garments (20). An ironing board (40) and an adjacent standby area (41), which are both permeable to steam, are arranged on top of the enclosure (10). During operation of the device (1), the ironing board (40) and a steam iron (30) are used to iron garments (20) which have first been moistened inside the enclosure (10). In the process, steam released by the iron (30) penetrates the garments (20) and enters the enclosure (10) through the ironing board (40). In this way, both the garments (20) on the ironing board (40) and those inside the enclosure (10) are treated by means of steam that is released by the iron (30), and steam is used in an efficient manner. A pressed look is obtained in that the garments (20) are subjected to a moistening process and a subsequent steam ironing process.

11 Claims, 6 Drawing Sheets

U.S. PATENT DOCUMENTS

Figure 1:
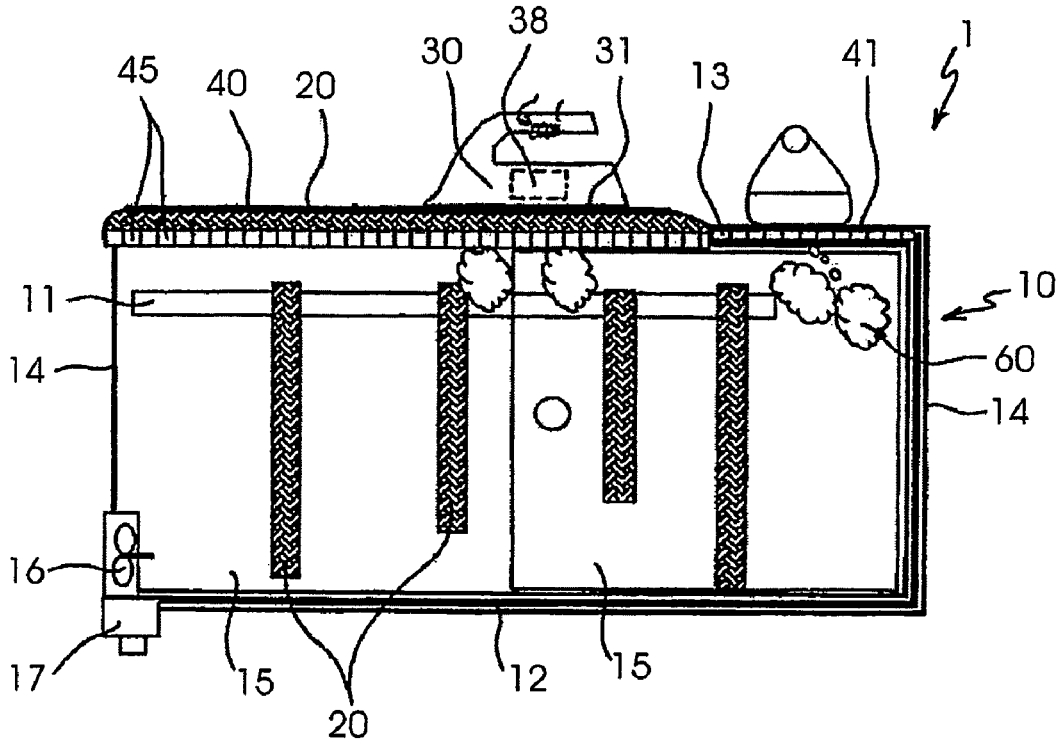

| | | | | | |
|---|---|---|---|---|---|
| 4,875,301 | A | * | 10/1989 | Adams | 38/14 |
| 5,636,773 | A | * | 6/1997 | Harrod et al. | 223/57 |
| 5,815,961 | A | | 10/1998 | Estes et al. | |
| 6,189,346 | B1 | * | 2/2001 | Chen et al. | 68/5 R |

FOREIGN PATENT DOCUMENTS

| | | | |
|---|---|---|---|
| EP | 1 159 893 | | 5/2001 |
| GB | 2 155 500 | | 9/1985 |
| KR | 200201898 | * | 8/2000 |

* cited by examiner

DEVICE FOR DE-WRINKLING GARMENTS

The present invention relates to a device for treating garments, in particular for de-wrinkling garments.

Such a device is known and is normally applied after the garments have been washed. As a result of the washing process, the garments are wrinkled, in particular if the garments are made from natural fibres. As people normally do not like to wear garments in a wrinkled state, many solutions have been proposed to de-wrinkle the garments. For example, many types of irons have been developed, which comprise a heatable sole plate for contacting the garments. For the purpose of removing wrinkles from the garments, the garments are positioned on an ironing board, and the hot iron is moved over the garments. It is commonly known that ironing is a very bothersome and labor-intensive process. In less labor-intensive solutions, the garments are steamed and dried in an enclosure. The steaming process is aimed at removing the wrinkles from the clothes. It is found in practice that the results of the ironing or steaming process, or any other known process of treating garments in order to de-wrinkle the garments, are often unsatisfactory.

U.S. Pat. No. 3,576,079 discloses a clothes steaming and drying apparatus having an enclosed chamber. At the top of the chamber, a slot which forms a support for hangers is arranged, so that the clothes may be hung in the chamber on the hangers. A steamer unit having a water pan and a heating element are arranged at the bottom of the chamber. During operation, the chamber is filled with steam produced by the steamer unit. Furthermore, the known apparatus comprises a fan, in order to blow hot air through the clothes in the chamber for drying purposes once the clothes have been steamed.

A problem associated with the apparatus known from U.S. Pat. No. 3,576,079 is that the extent to which wrinkles are removed from the clothes is dependent on a stretching force caused by the weight of the clothes and/or the internal stress prevailing in the clothes. Since different clothes are made from different materials and have different shapes and sizes, it is not possible to obtain satisfactory results for all clothes treated by means of the apparatus. Therefore, at least some clothes need to be treated further and need, for example, to be ironed. However, the apparatus known from U.S. Pat. No. 3,576,079 does not comprise any integrated ironing tools or the like.

U.S. Pat. No. 5,815,961 discloses a clothes treating apparatus comprising a cabinet for receiving clothes, a steam generation means for introducing moist air into the cabinet for humidifying the clothes located inside the cabinet, and a heater and a fan for supplying heated air into the cabinet for drying said clothes. An inflatable hanger is disposed inside the cabinet for supporting the clothes. During operation of the apparatus, steam is introduced into the cabinet while the inflatable hanger is periodically inflated. In this way, an attempt is made to remove the wrinkles from clothes which are located inside the cabinet. However, it is not possible to remove the wrinkles from all types of clothes, as the extent to which the clothes can be stretched is limited. Therefore, at least some clothes which have been treated in the apparatus known from U.S. Pat. No. 5,815,961 need to be subjected to a further de-wrinkling process, for example an ironing process. However, like the above-described apparatus known from U.S. Pat. No. 3,576,079, the apparatus known from U.S. Pat. No. 3,576,079 does not comprise any integrated ironing tools or the like.

EP 1,159,893 discloses a clothes drying, de-wrinkling, and ironing cabinet having a main enclosure for housing the clothes and means for drying and de-wrinkling the clothes in said enclosure. Furthermore, this known cabinet comprises an ironing tool, namely a foldable ironing board unit which is mounted on the inside of a door of the enclosure. In this way, once a drying and de-wrinkling process has taken place in the enclosure, a user has the possibility of opening the enclosure, setting up the ironing board unit, and ironing the clothes that need further ironing.

A disadvantage associated with the cabinet known from EP 1,159,893 is that the obtained results may not meet the expectation of users who want to give their clothes a pressed look, especially if the clothes are made from natural fibres. At least for some clothes, it appears to be impossible to remove all wrinkles by first drying and de-wrinkling the clothes in the enclosure, and then ironing the clothes.

It is an objective of the present invention to provide a device for treating garments which offers a user the possibility of obtaining a pressed look for all types of garments, including garments made of natural fibres. This objective is achieved by means of a device for treating garments, in particular for de-wrinkling garments, comprising:

- a garment holding enclosure for receiving, enclosing, and moistening garments;
- at least one garment moistening tool having at least one outlet for supplying a moistening agent to garments located outside the garment holding enclosure; and
- moistening agent supplying means for supplying the moistening agent to the garment holding enclosure.

An insight underlying the present invention is that an effective method for de-wrinkling garments comprises the step of pre-moistening the garments within an enclosure, followed by the step of further treating the moistened garments outside the enclosure with moistening agent. In this way, it is even possible to de-wrinkle garments made of natural fibres. The device according to the present invention offers a user the possibility to apply this effective method, as this device comprises a garment holding enclosure for moistening the garments and a garment moistening tool for supplying moistening agent to the garments located outside the enclosure. The moistening agent may be, for example, water.

When the device according to the present invention is applied, the garments are not dried prior to being subjected to an ironing process. Instead, during a process of treating the garments, the garments are taken from the enclosure in a moistened state. When the garments are subsequently treated with moistening agent by means of the garment moistening tool, which may be, for example, a steam iron, a pressed look is obtained.

In a preferred embodiment, the garment treatment device comprises vaporizing means for putting the moistening agent into a vaporized state. In the case of the moistening agent being water, the vaporizing means may be a steam generator.

When moistening agent vapor is applied, it is possible that the garment moistening tool is not only used to supply moistening agent vapor to the garments located outside the enclosure, but also to supply moistening agent vapor to the enclosure. For example, the moistening agent may be water, and the device according to the invention may comprise a steam iron, an ironing board for supporting the garments during a steam ironing process, and a standby area for supporting the steam iron during the time it is not moved over the garments, wherein both the ironing board and the standby area are located on top of the enclosure and are arranged to allow steam to pass from the steam iron to the enclosure. A process in which the steam iron is used for supplying steam both to the garments located outside the enclosure and to the enclosure itself may take place while the garments are being ironed by the steam iron, but may also take place while the steam iron is temporarily not used and is put on the standby area It will be understood that an important advantage of this preferred embodiment is a reduction of waste of steam. Furthermore, the fact that the steam penetrates the ironing board during the steam ironing process means that the garments are moistened in a more effective manner. As an advantageous result, the steam ironing process can be more effective, and the ironing results are improved.

Figure 2:
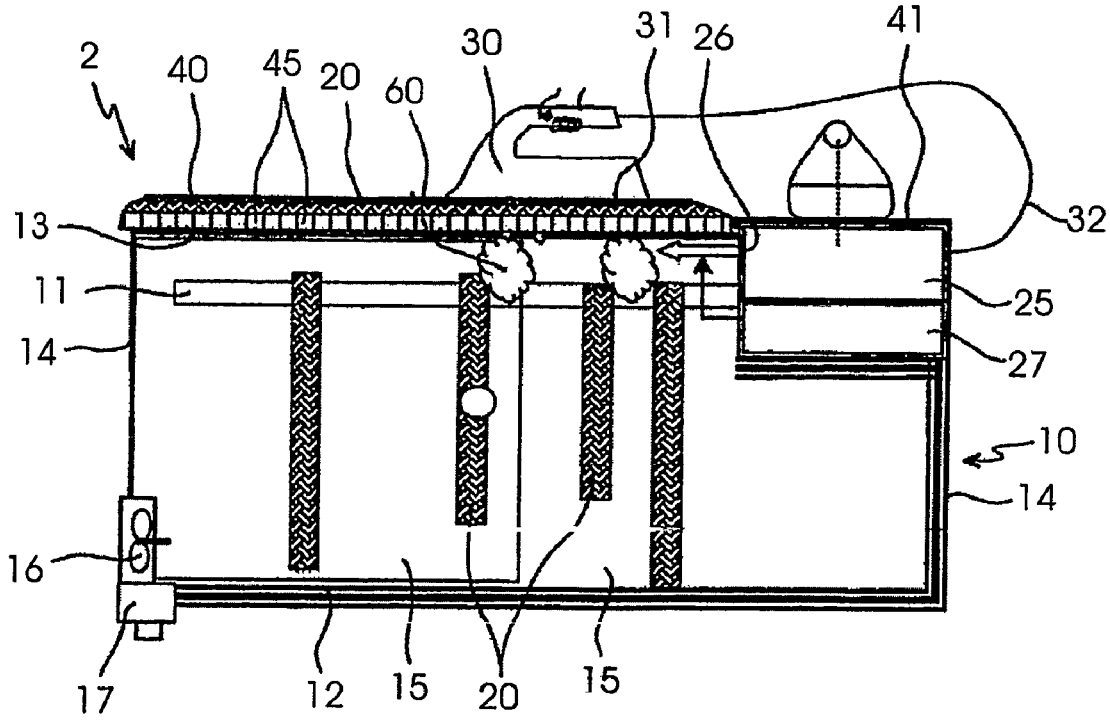
Figure 3:
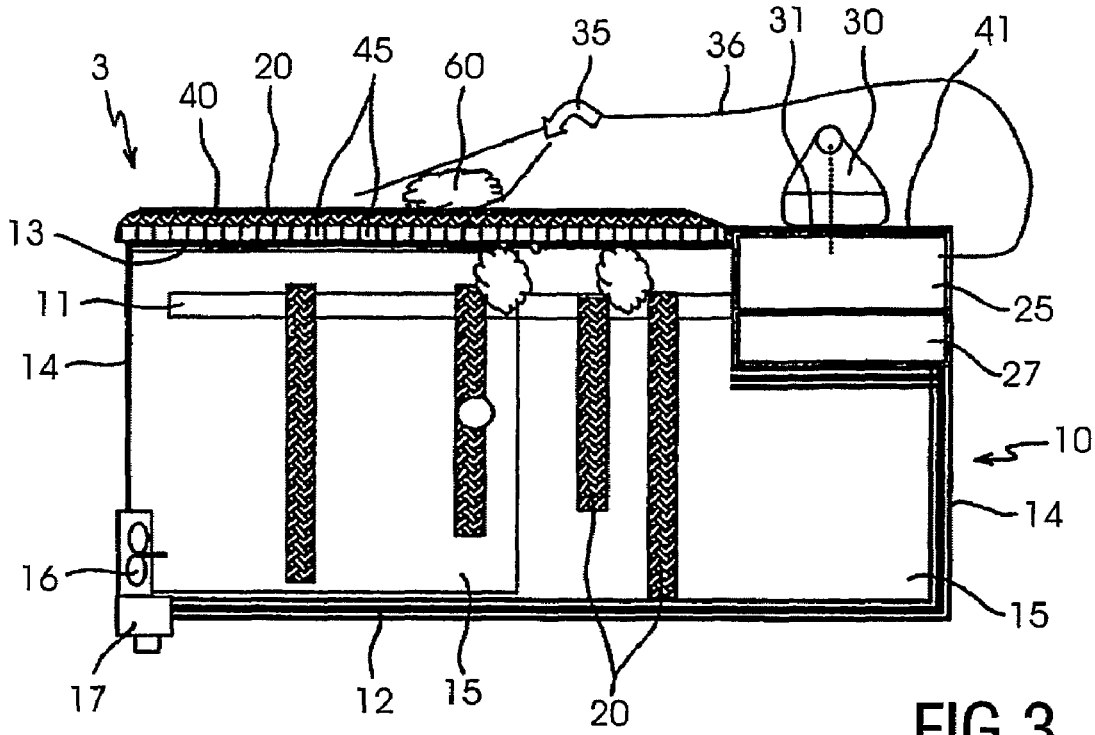
Figure 4:
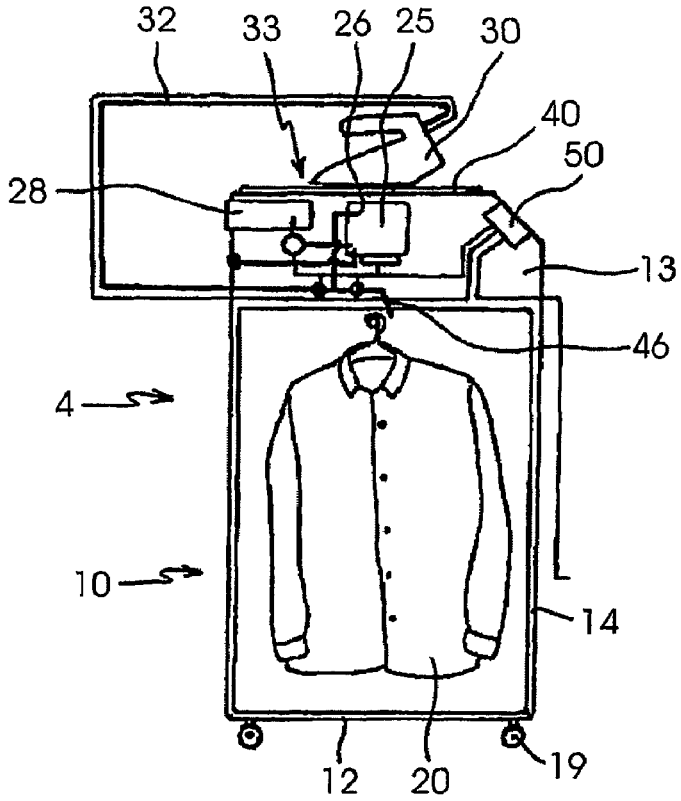
Figure 5:
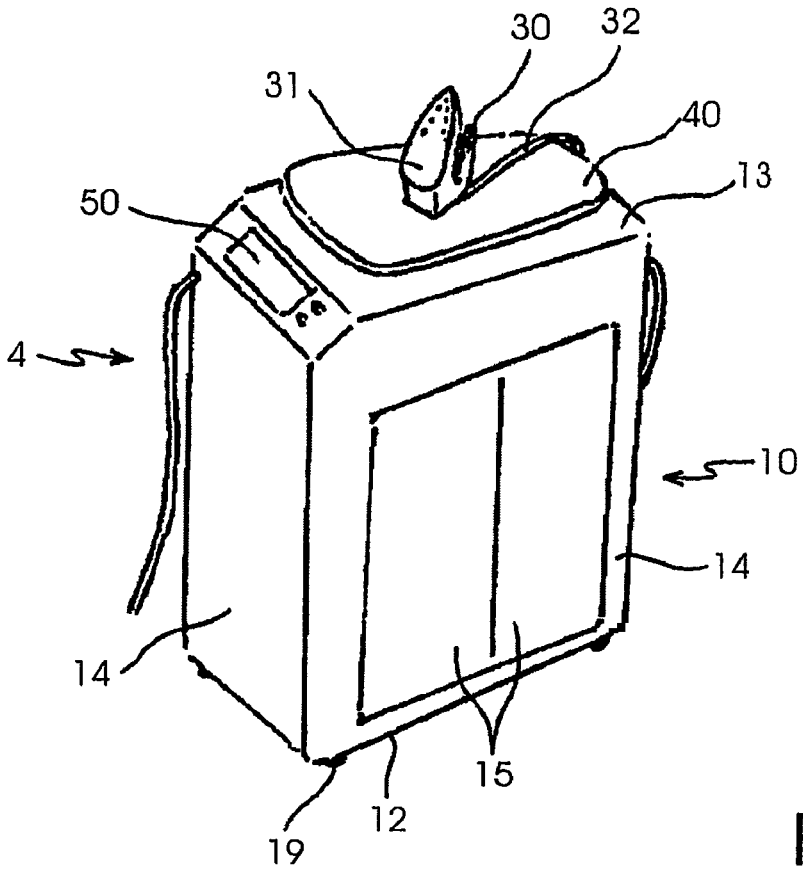
Figure 6:
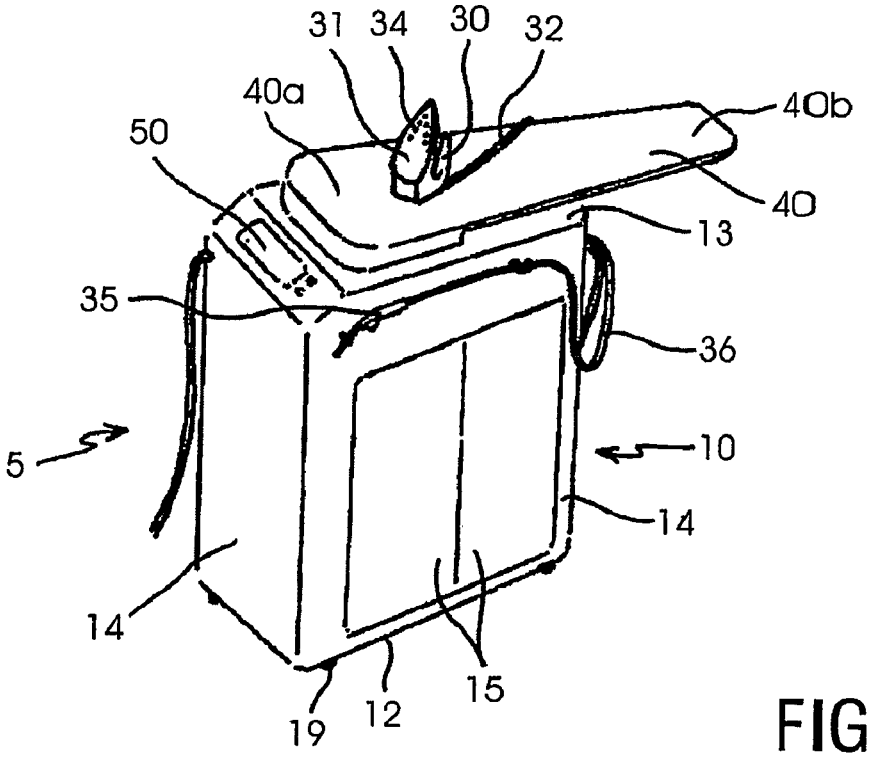
Figure 7:
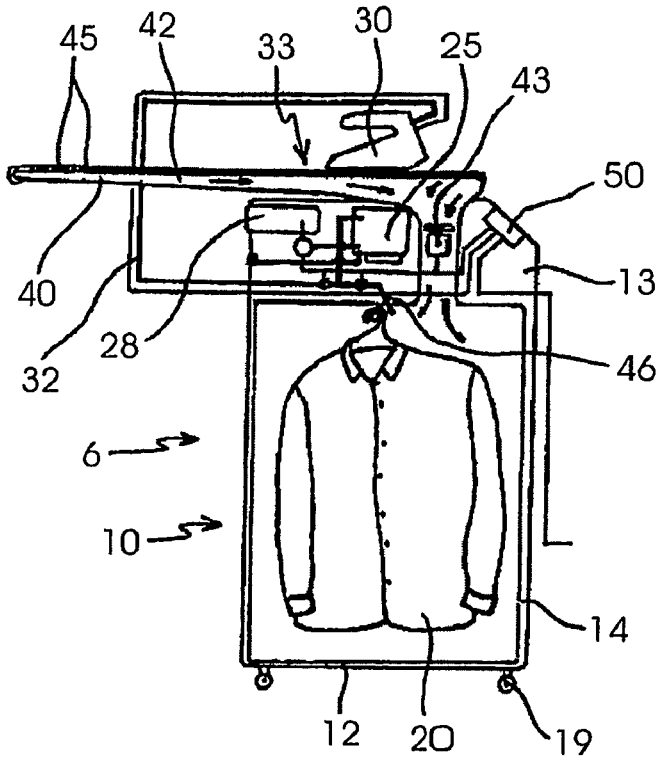
Figure 8:
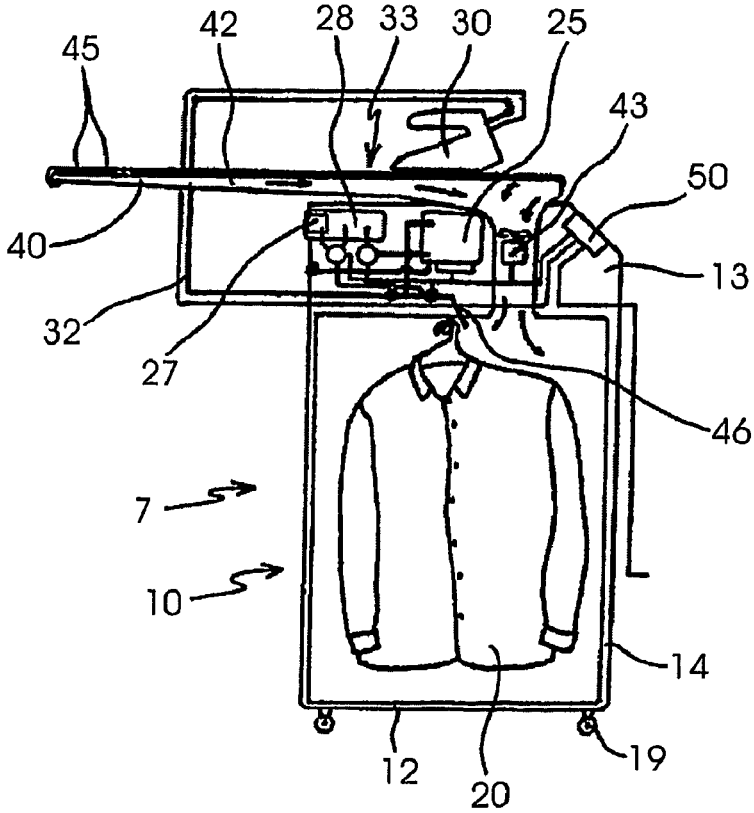
Figure 9:
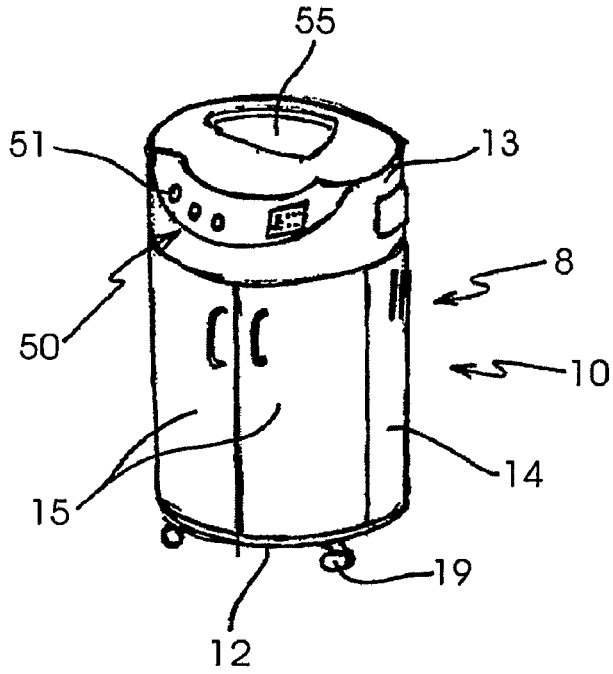
Figure 10:
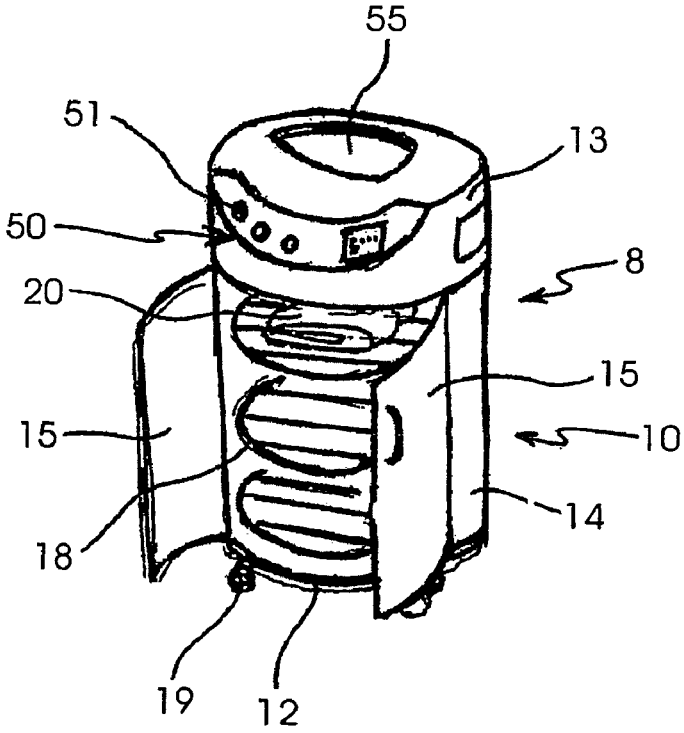
Figure 11:
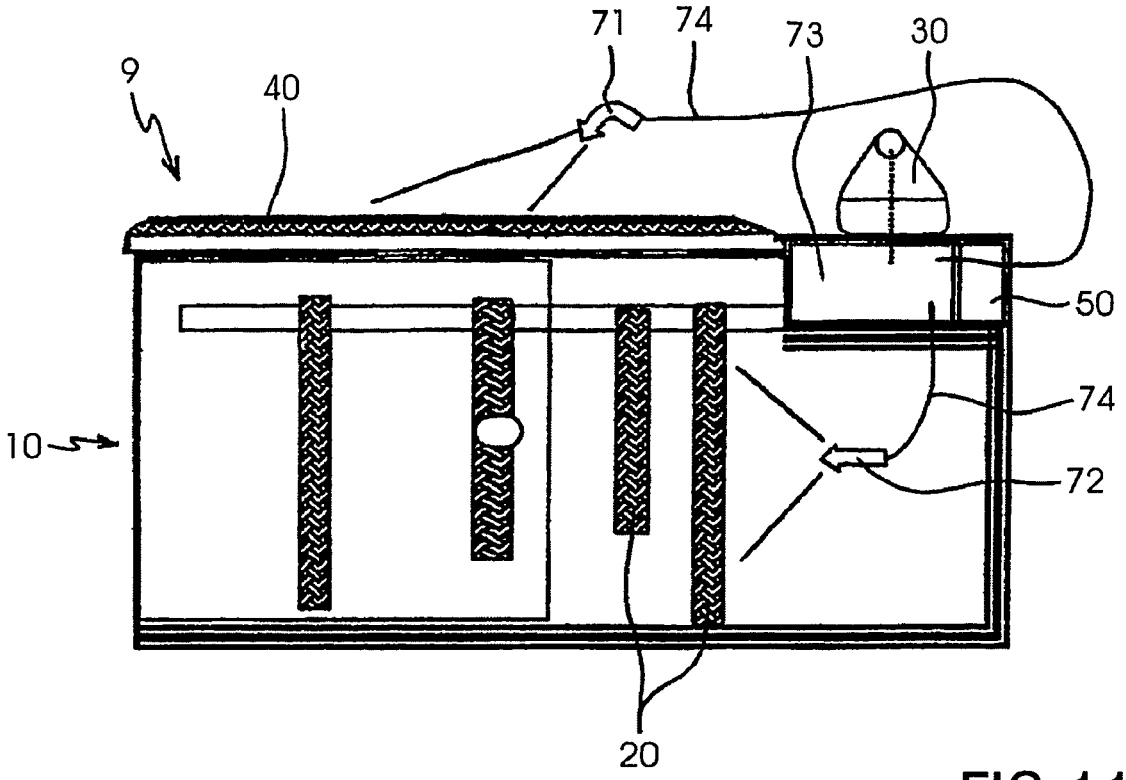
Figure 12:
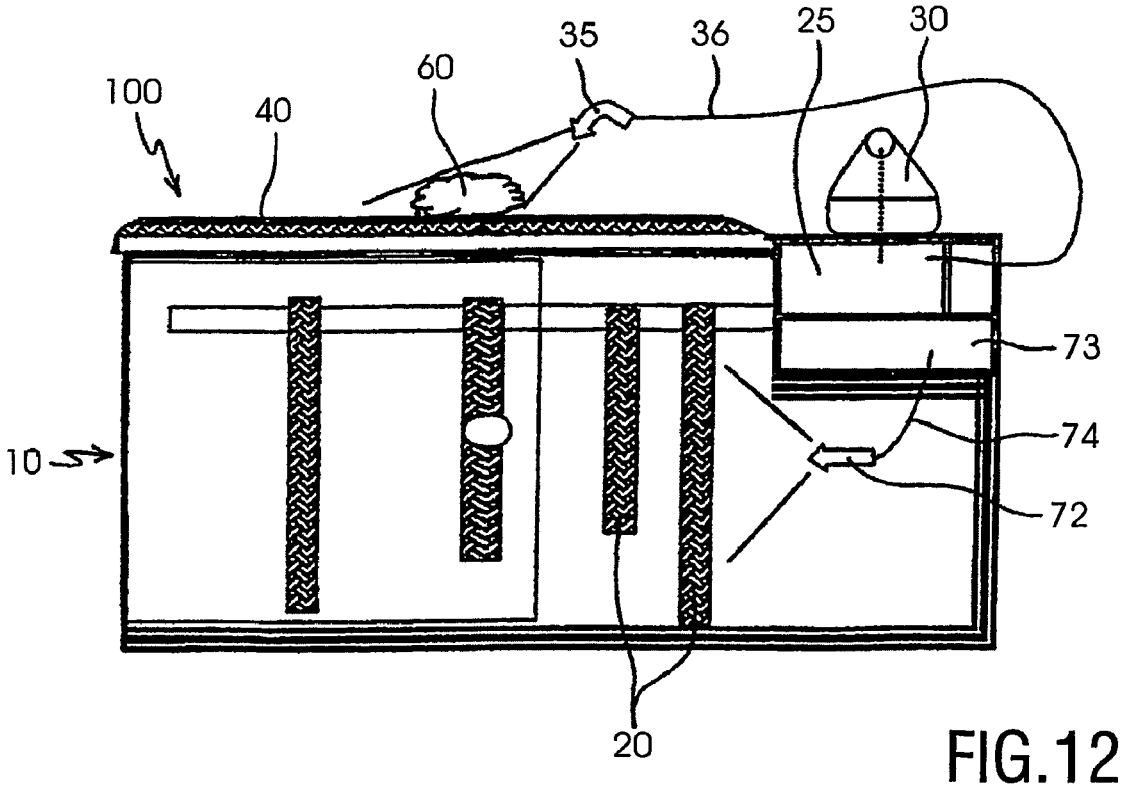

The present invention will now be explained in greater detail with reference to the Figures, in which similar parts are indicated by the same reference signs, and in which:

FIG. 1 diagrammatically shows a sectional view of a garment de-wrinkling device according to a first preferred embodiment of the present invention;

FIG. 2 diagrammatically shows a sectional view of a garment de-wrinkling device according to a second preferred embodiment of the present invention;

FIG. 3 diagrammatically shows a sectional view of a garment de-wrinkling device according to a third preferred embodiment of the present invention;

FIG. 4 diagrammatically shows a sectional view of a garment de-wrinkling device according to a fourth preferred embodiment of the present invention;

FIG. 5 diagrammatically shows a perspective view of the garment de-wrinkling device as shown in FIG. 4;

FIG. 6 diagrammatically shows a perspective view of a garment de-wrinkling device according to a fifth preferred embodiment of the present invention;

FIG. 7 diagrammatically shows a sectional view of a garment de-wrinkling device according to a sixth preferred embodiment of the present invention;

FIG. 8 diagrammatically shows a sectional view of a garment de-wrinkling device according to a seventh preferred embodiment of the present invention;

FIG. 9 diagrammatically shows a perspective view of a garment de-wrinkling device according to an eighth preferred embodiment of the present invention;

FIG. 10 diagrammatically shows a perspective view of the garment de-wrinkling device as shown in FIG. 9, wherein a portion of an interior of the device is shown;

FIG. 11 diagrammatically shows a sectional view of a garment de-wrinkling device according to a ninth preferred embodiment of the present invention; and FIG. 12 diagrammatically shows a sectional view of a garment de-wrinkling device according to a tenth preferred embodiment of the present invention.

FIG. 1 shows a garment de-wrinkling device according to a first preferred embodiment of the present invention. This garment de-wrinkling device will be referred to as first device 1 for the sake of simplicity below.

The first device 1 comprises a garment holding enclosure 10 for receiving garments 20 to be treated by means of the first device 1. The garments 20 may be placed inside the enclosure 10 in any suitable conventional way. For example, the garments 20 may be placed on a hanger (not shown in FIG. 1), and the enclosure 10 may be provided with a bar 11 onto which the hangers may be hung. According to another possibility, the enclosure 10 may be provided with shelves (not shown in FIG. 1) for supporting the garments 20.

In the example as shown in FIG. 1, a casing of the enclosure 10 has a bottom portion 12, a top portion 13, and side walls 14. A space which is enclosed by the bottom portion 12, the top portion 13, and the side walls 14 is accessible through doors 15, which are provided in one of the side walls 14 of the enclosure 10. The number of doors 15 is not essential; the enclosure 10 may comprise, for example, one or two doors 15. Also, the way in which the doors 15 are arranged is not essential; the doors 15 may be, for example, hinged or sliding.

For the purpose of subjecting garments 20 to an ironing process, the first device 1 comprises a steam iron 30 having a heatable sole plate 31. The top portion 13 of the enclosure 10 comprises an ironing board 40 for supporting garments 20 during the ironing process and a standby area 41 for receiving the iron 30 during the time it is not used for ironing garments 20. The standby area 41 is designed such that it is not burned when it is contacted and heated by the heated sole plate 31 of the iron 30. FIG. 1 shows the iron 30 twice: once in a position at the ironing board 40 and once in a position at the standby area 41.

According to an important aspect of the present invention, the top portion 13 of the enclosure 10 and the ironing board 40 comprises steam inlets 45 which are capable of letting in steam to the enclosure 10. The steam inlets 45 may be clearly distinguishable as separate holes, or they may be alternatively shaped, for example as minuscule channels in a material that is permeable to steam. In the first device 1, an internal steam generator 38 is arranged inside the iron 30. During operation of the iron 30, steam is generated by the steam generator 38, and the steam is supplied to an interior of the enclosure 10 when the iron 30 is moved over a garment 20 supported by the ironing board 40, and when the iron 30 is resting on the standby area 41. In FIG. 1, steam clouds are diagrammatically depicted and indicated by means of reference sign 60.

The first device 1 comprises a fan 16 for ensuring a good distribution of steam within the enclosure 10. Furthermore, the first device 1 comprises a water collector 17 for collecting water which is obtained when steam is condensed. Naturally, both the fan 16 and the water collector 17 are arranged inside the enclosure 10. The first device 1 preferably also comprises heating means (not shown) for keeping the temperature inside the enclosure 10 above ambient temperature. The temperature of the garments 20 which are present inside the enclosure 10 may also be kept above ambient temperature in the process.

The way in which garments 20 are treated by means of the first device 1 will now be explained. First the steam iron 30 is actuated, so that the sole plate 31 of the iron 30 heats up and the internal steam generator 38 starts to generate steam. Normally, in order to avoid burning of the ironing board 40, the iron 30 is placed on the standby area 41. Furthermore, garments 20 to be treated are placed inside the enclosure 10. It will be understood that it makes no difference for the operation of the first device 1 whether the garments 20 are hung inside the enclosure 10 before or after the iron 30 is actuated.

The steam that is released by the iron 30 at the standby area 41 is supplied to the enclosure 10 through the steam inlets 45. The fan 16 is actuated so as to distribute the steam within the enclosure 10. The steam penetrates the garments 20 located within the enclosure 10, whereby the garments 20 are brought into a moistened state.

In order to further treat a moistened garment 20, a user takes the garment 20 out of the enclosure 10 and places the garment 20 on the ironing board 40. Subsequently, the user takes up the iron 30 from the standby area 41 and irons the garment 20 by moving the iron 30 over the garment 20 in such a way that the garment 20 is pressed between the heated sole plate 31 of the iron 30 and the ironing board 40. An important advantage of the fact that the garment 20 is in a moistened state is that wrinkles can be more easily removed, whereby the duration of the ironing process is reduced.

During the ironing process, steam released by the iron 30 penetrates the garment 20 being ironed, reaches the ironing board 40, and is supplied to the enclosure 10 through the steam inlets 45 in the ironing board 40. The fact that the steam is allowed to pass through the ironing board 40 enhances the effectiveness of the ironing process. During operation of the iron 30, the enclosure 10 is continually provided with steam, as the enclosure 10 is not only provided with steam when the iron 30 rests on the standby area, but also when the iron 30 is being moved over a garment 20 supported by the ironing board 40.

A pressed look is obtained after a garment 20 has been subjected to a moistening process within the enclosure 10 and to a subsequent ironing process on the ironing board 40. Wrinkles have disappeared as a consequence of the fact that the garment 20 has been treated in two steps, wherein during the first step the garment 20 was hung in the enclosure 10 which is continually provided with steam, and wherein during the second step the garment 20 was pressed between the steam iron 30 and the ironing board 40. During operation of the first device 1, steam is continually generated by the steam iron 30, steam is continually supplied to the enclosure 10 through the standby area 41 and the ironing board 40, which are both present on the top portion 13 of the enclosure 10, and condensed steam is collected by a water collector 17.

In the first device 1, the steam generated by the internal steam generator 38 of the iron 30 is used in an efficient way. During conventional steam ironing processes, part of the generated steam penetrates the garment which is ironed, and part of the generated steam is simply wasted. During the steam ironing process which takes place when the first device 1 is applied, the generated steam is not only used to penetrate the garment 20 which is present on the ironing board 40, but also to enter the enclosure 10 and moisten the garments 20 which are present inside the enclosure 10.

FIG. 2 shows a garment de-wrinkling device according to a second preferred embodiment of the present invention. This garment de-wrinkling device will be referred to as second device 2 for the sake of simplicity below. In FIG. 2, steam clouds are diagrammatically depicted and indicated by means of reference sign 60. Furthermore, FIG. 2 shows the iron 30 twice: once in a position at the ironing board 40, and once in a position at the standby area 41.

The second device 2 resembles the first device 1 to a large extent; under the application of the second device 2, the garments 20 are also firstly subjected to a moistening process inside the enclosure 10 and subsequently subjected to a steam ironing process which takes place outside the enclosure 10. However, an important difference is that the second device 2 comprises a steam generator 25 which is located inside the enclosure 10 and is attached to the enclosure 10, while the iron 30 is connected to the steam generator 25 by means of a steam hose 32. Thus the generation of steam takes place inside the enclosure 10 instead of inside the steam iron 30 during operation of the second device 2.

The steam generator 25 comprises at least one steam opening 26 for releasing steam inside the enclosure 10. In FIG. 2, a steam flow at the steam opening 26 is diagrammatically depicted by means of an arrow. During operation of the second device 2, the steam generator 25 supplies steam to the garments 20 inside the enclosure 10 through the steam opening 26, whereas the steam generator 25 supplies steam to the garment 20 on the ironing board 40 through the steam hose 32 and the iron 30. As the steam generator 25 is arranged such as to supply steam to both the garments 20 within the enclosure 10 and those outside the enclosure 10, it is not necessary that the top portion 13 of the enclosure 10 and the ironing board 40 comprise steam inlets 45 for letting in steam released by the iron 30 into the enclosure 10. Despite this fact, it is preferred that the second device 2 comprises steam inlets 45 in conformity with what is shown in FIG. 2, so that the generated steam can be used in an efficient manner.

Preferably, the second device 2 comprises a container 27 for containing garment treatment liquid. Consequently, in the second device 2, the generated steam may be enriched by adding garment treatment liquid, which has a positive influence on the de-wrinkling process of the garments 20. The container 27 may, for example, comprise an injector (not shown in FIG. 2) for injecting the garment treatment liquid into fresh steam, i.e. steam that has just been released by the steam generator 25 through the steam opening 26 during operation of the second device 2. In FIG. 2, a flow of garment treatment liquid in the direction of the steam flow at the steam opening 26 is diagrammatically depicted by means of an arrow.

FIG. 3 shows a garment de-wrinkling device according to a third preferred embodiment of the present invention. This garment de-wrinkling device will be referred to as third device 3 for the sake of simplicity below. In FIG. 3, steam clouds are diagrammatically depicted and indicated by means of reference sign 60.

In comparison with the second device 2, the third device 3 comprises an additional steam sprayer 35 which is connected to the steam generator 25 through a steam hose 36. In FIG. 3, the steam sprayer 35 is diagrammatically depicted by means of a bent arrow. The third device 3 also comprises an iron 30, but this iron 30 is not connected to the steam generator 25. This does not alter the fact that the iron 30 may be a steam iron which is capable of generating steam itself by means of an internal steam generator 38, nor the fact that the iron 30, like the steam sprayer 35, may be connected to the steam generator 25.

During operation of the third device 3, the steam sprayer 35 is used to supply steam to the garments 20 on the ironing board 40 as well as to the garments 20 inside the enclosure 10. For the purpose of the latter function of the steam sprayer 35, the ironing board 40 comprises steam inlets 45 for letting in steam to the enclosure 10. During the steam ironing process, the garments 20 are first sprayed with steam by means of the steam sprayer 35 and subsequently contacted by the heated sole plate 31 of the iron 30.

In a feasible alternative of the third device 3, the steam generator 25 comprises at least one steam opening 26 for releasing steam inside the enclosure 10. In such an alternative device, the steam generator 25 serves to supply steam to both the garments 20 within the enclosure and those outside the enclosure 10, through the steam opening 26 and the steam hose 36 plus the steam sprayer 35, respectively. Therefore, it is possible in the alternative device that the steam inlets 45 in the top portion 13 of the enclosure 10 and in the ironing board 40 are omitted, although this is not preferred.

FIGS. 4 and 5 show a garment de-wrinkling device according to a fourth preferred embodiment of the present invention. This garment de-wrinkling device will be referred to as fourth device 4 for the sake of simplicity below.

The fourth device 4 comprises a steam generator 25 which is connected to a steam pipe 46 opening into the enclosure 10, through a steam opening 26 which is arranged in the steam generator 25 and a steam hose system 33 connected thereto. Both the steam generator 25 and the steam hose system 33 are advantageously arranged in the top portion 13 of the enclosure 10.

The steam generator 25 is also connected to a water container 28 and an iron 30. The connection between the steam generator 25 and the iron 30 is realized by means of a relatively long steam hose 32, which is connected to the steam hose system 33. A control unit 50 is provided, which comprises inter alia a timer for setting the time during which steam needs to be supplied to the enclosure 10 in order to ensure that the garments 20 inside the enclosure 10 are sufficiently moistened.

In the fourth device 4, the garments 20 inside the enclosure 10 are moistened by means of steam that is generated by the steam generator 25 and that is supplied to the enclosure 10 by means of the steam hose system 33 and the steam pipe 46. During a steam ironing process in which a garment 20 is placed on an ironing board 40 positioned on top of the enclosure 10, steam is supplied to the garment 20 by means of the iron 30, which steam also originates from the steam generator 25.

FIG. 6 shows a garment de-wrinkling device according to a fifth preferred embodiment of the present invention. This garment de-wrinkling device will be referred to as fifth device 5 for the sake of simplicity below.

Like the third device 3, the fifth device 5 comprises a steam sprayer 35. The fifth device 5 also comprises a steam iron 30 having steam outlets 34 which are arranged in the sole plate 31. Like the fourth device 4, the fifth device 5 comprises a steam generator 25 (not shown in FIG. 6) and a steam hose system 33 (also not shown in FIG. 6), such that the steam iron 30 is connected to the steam generator 25 through the steam hose system 33 and a relatively long first steam hose 32 connected thereto, and the steam sprayer 35 is connected to the steam generator 25 through the steam hose system 33 and a relatively long second steam hose 36 connected thereto.

It is not essential that the steam iron 30 is connected to the steam generator 25; the steam iron 30 may be capable of generating steam itself by means of an internal steam generator 38.

In comparison with the fourth device 4, a first important difference is realized by the presence of the steam sprayer 35, while a second important difference relates to the shape of the ironing board 40. In the fourth device 4, the ironing board 40 only covers the top of the enclosure 10, whereas in the fifth device 5 a first portion 40*a* of the ironing board 40 covers the top of the enclosure 10 and a second portion 40*b* of the ironing board 40 extends beyond the top of the enclosure 10. In this way, a larger surface for supporting the garments 20 to be ironed is available, which may lead to a reduction of the number of times a garment 20 on the ironing board 40 needs to be rearranged during the steam ironing process.

FIG. 7 shows a garment de-wrinkling device according to a sixth preferred embodiment of the present invention. This garment de-wrinkling device will be referred to as sixth device 6 for the sake of simplicity below.

In the sixth device 6, the ironing board 40 is provided with steam inlets 45 which are capable of letting in steam to the enclosure 10. For this purpose, the ironing board comprises a hollow section 42 which opens into the enclosure 10. During the steam ironing process, steam released by the iron 30 penetrates the garment 20 present on the ironing board 40 and enters the hollow section 42 of the ironing board 40 through the steam inlets 45. Advantageously, a fan 43 is arranged inside the hollow section 42 for directing the steam towards the enclosure 10. In this way, the steam is forced to follow a course as diagrammatically depicted by means of arrows in FIG. 7.

During operation of the sixth device 6, the steam released by the iron 30 is not only used for the purpose of steam ironing a garment 20 which is positioned on the ironing board 40, but also for the purpose of pre-moistening garments 20 which are located inside the enclosure 10. As a consequence, waste of steam is reduced, and the obtained result is outstanding, i.e. a garment 20 that is treated under the application of the sixth device 6 obtains a pressed look.

FIG. 8 shows a garment de-wrinkling device according to a seventh preferred embodiment of the present invention. This garment de-wrinkling device will be referred to as seventh device 7 for the sake of simplicity below.

The seventh device 7 resembles the sixth device 6 to a large extent. However, an important difference is that the water container 28 is directly connectable to the steam pipe 46 through the steam hose system 33. In this way it is possible to inject water into the steam hose system 33 in order to increase the wetness of the steam that is supplied to the enclosure 10. Furthermore, the seventh device 7 comprises a container 27 for containing a garment treatment liquid, which is also directly connectable to the steam pipe 46, through the steam hose system 33. Preferably, the control unit 50 is provided with buttons (not shown) or the like, by means of which a user of the seventh device 7 is capable of controlling the wetness of the steam that is supplied to the enclosure 10 as well as the amount of garment treatment liquid that is supplied to the enclosure 10.

In FIGS. 9 and 10, a garment de-wrinkling device according to an eighth preferred embodiment of the present invention is shown. This garment de-wrinkling device will be referred to as eighth device 8 for the sake of simplicity below.

The enclosure 10 of the eighth device 8 comprises a bottom portion 12, a top portion 13, one curved side wall 14, and two doors 15. A number of shelves 18 for supporting the garments 20 are arranged inside the enclosure 10. The shelves 18 are shaped as grids, so that the moistening process of the garments 20 is not hindered by the presence of the shelves 18.

The eighth device 8 comprises a steam generator 25 (not shown in FIGS. 9 and 10) for supplying steam to the enclosure 10. The control unit 50 comprises a button 51 for initializing the moistening process of the garments inside the enclosure 10.

According to an important aspect of the present invention, a resting pad 55 for supporting a steam iron 30 is present on top of the eighth device 8. Advantageously, the resting pad 55 is provided with steam inlets 45, so that the enclosure 10 may receive steam that is released by an iron 30 positioned on the resting pad 55.

The eighth device 8 may comprise means (not shown) for attaching an ironing board 40 to and detaching the ironing board 40 from the eighth device 8. Naturally, it is also possible that a separate ironing board 40 is used during a steam ironing process in which moistened garments 20 taken from the enclosure 10 are ironed.

Despite the fact that all examples discussed above with reference to the Figures show that steam is used to treat the garments 20, if desired enriched with water in a liquid form or with a garment treatment liquid, it is possible within the scope of the present invention to use only a moistening agent in liquid form. In principle, it is possible to use any suitable moistening agent in a gaseous form or in liquid form, or to use a mixture of vaporized moistening agent and liquid moistening agent.

In fact, when steam or another moistening agent vapor is used to treat the garments 20, the garments 20 are not moistened by the steam or moistening agent vapor as such, but by water droplets or moistening agent droplets which are generated as a result of condensation of the steam or moistening agent vapor. Moistening of the garments 20 in this way is very effective. Furthermore, it is a feasible possibility to provide an ironing board 40 and an enclosure 10 which are at least partly permeable to steam or another vapor, as is illustrated by a number of the examples discussed above so that the water or moistening agent which is used to treat the garments 20 outside the enclosure 10 may also be used to treat the garments 20 located inside the enclosure 10. However, these advantages of the application of steam or another moistening agent vapor do not alter the fact that it is also possible to moisten the garments 20 by spraying the garments 20 with water or another moistening agent in liquid form.

An embodiment of the garment de-wrinkling device according to the present invention, in which the garments 20 are only treated by means of water in liquid form, is shown in FIG. 11. This garment de-wrinkling device will be referred to as ninth device 9 for the sake of simplicity below. In conformity with the other devices as shown in FIGS. 1-8, the ninth device 9 comprises inter alia an enclosure 10, an iron 30, and an ironing board 40.

The ninth device 9 comprises two sprayers, one sprayer being an external sprayer 71 which is located outside the enclosure 10, and another sprayer being an internal sprayer 72 which is located inside the enclosure 10. In FIG. 11, the external sprayer 71 is diagrammatically depicted by means of a bent arrow, and the internal sprayer 72 is diagrammatically depicted by means of a straight arrow.

Both sprayers 71, 72 are connected to a water container 73 through a water hose 74. Preferably, both sprayers 71, 72 comprise a large number of tiny outlets (not shown in FIG. 11), so that the sprayers 71, 72 are capable of creating a mist of minuscule water droplets. In this way, it is very well possible to moisten the garments 20, both inside the enclosure 10 and outside the enclosure 10, while it is not necessary to heat the water in order to generate steam.

Preferably, the temperature prevailing in the enclosure 10 is above ambient temperature, for example 40° C. or 50° C. Therefore, the ninth device 9 is preferably equipped with heating means (not shown) for realizing such a temperature.

In the ninth device 9, the operation of the external sprayer 71 is controlled by a user, whereas the operation of the internal sprayer 72 is controlled by a control unit 50 which is actuated by the user at the start of a garment treatment process.

The external sprayer 71 may be arranged as a separate element of the ninth device 9, but may also, for example, be an integrated part of the iron 30. The first possibility is shown in FIG. 11.

Advantageously, the outlets of the internal sprayer 72 are located in many different positions in the enclosure 10, so that it is possible to spray all garments 20 inside the enclosure 10, and to spray more than one side of the garments 20.

Since the water which is supplied to the sprayers 71, 72 is not heated, the ninth device 9 may very well be used for the purpose of de-wrinkling only a small number of garments 20, for example one or two garments 20. From an economical point of view, it is advantageous in such a situation that no heating process of the water supplied to the sprayers 71, 72 needs to take place in the ninth device 9. Furthermore, it is advantageous in such a situation if the ninth device 9 comprises a so-called dry iron 30, i.e. an iron that is not a steam iron 30, so that, only the sole plate 31 of the iron 30 needs to be heated at the start of a garment treatment process.

As was noted above, it is possible to use both a moistening agent liquid and a moistening agent vapor for the purpose of treating the garments 20. Within the scope of the present invention, this way of treating the garments 20 may be applied both to the garments 20 inside the enclosure 10 and to the garments 20 outside the enclosure 10, but it may also be applied to only one of these two categories of garments 20. For example, the iron 30 of the ninth device 9 may be a steam iron 30 having an internal steam generator 38, so that the garments 20 outside the enclosure can be simultaneously treated by means of sprayed water and steam, whereas the garments 20 inside the enclosure 10 are only treated by means of sprayed water. If the ironing board 40 and the top portion 13 of the enclosure 10 are permeable to steam, the garments 20 inside the enclosure 10 may also be treated by means of both sprayed water and steam. According to another option, a steam generator 25 may be located inside the enclosure 10 for the purpose of additionally treating the garments 20 inside the enclosure 10 by means of steam.

It is also possible to use only a moistening agent liquid to treat the garments 20 located outside the enclosure 10, and to use only a moistening agent vapor to treat the garments 20 located inside the enclosure 10, or the other way round. An embodiment of the garment de-wrinkling device according to the present invention, in which the garments 20 outside the enclosure 10 are only treated by means of steam, and in which the garments 20 inside the enclosure 10 are only treated by means of sprayed water, is shown in FIG. 12. This garment de-wrinkling device will be referred to as tenth device 100 for the sake of simplicity below. In conformity with the other devices as shown in FIGS. 1-8 and 11, the tenth device 100 comprises inter alia an enclosure 10, an iron 30, and an ironing board 40.

Like the third device 3, the tenth device 100 comprises a steam generator 25 and a steam sprayer 35 which is connected to the steam generator 25 through a steam hose 36 and which is located outside the enclosure 10. In FIG. 12, the steam sprayer 35 is diagrammatically depicted by means of a bent arrow. When the steam sprayer 35 is actuated by a user, steam is supplied to the garments 20 located outside the enclosure 10. In FIG. 12, a steam cloud is diagrammatically depicted and indicated by means of reference sign 60.

The tenth device 100, like the ninth device 9, comprises an internal sprayer 72 for the purpose of moistening the garments 20 inside the enclosure 10. In FIG. 12, the internal sprayer 72 is diagrammatically depicted by means of a straight arrow. The tenth device 100 further comprises a water container 73 which is in communication with the internal sprayer 72 through a water hose 74.

During operation of the tenth device 100, the garments 20 are successively moistened inside the enclosure 10 by means of sprayed water, taken out of the enclosure 10, placed on the ironing board 40, supplied with steam by actuation of the steam sprayer 35, and ironed by means of the iron 30. As a result of this garment treatment process, wrinkles are removed from the garments 20, and a pressed look is obtained.

It will be clear to those skilled in the art that the scope of the present invention is not limited to the examples discussed above, but that several amendments and modifications thereof are possible without deviating from the scope of the present invention as defined in the attached claims.

The enclosure 10 of the garment de-wrinkling device according to the present invention may be collapsible, so that it is possible to realize a situation in which less space is occupied by the enclosure 10 when it is not used for receiving and pre-moistening garments 20.

Advantageously, wheels 19 are arranged at the bottom portion 12 of the enclosure 10, so that it is very easy for a user to displace the entire garment de-wrinkling device. The option of the garment de-wrinkling device comprising wheels 19 is illustrated in FIGS. 4-10.

It is not necessary that the steam generator 25 having at least one steam opening 26 for releasing steam inside the enclosure 10 is actually located inside the enclosure 10. It will be understood that it is possible for the steam generator 25 to be located outside the enclosure 10, as long as its steam opening 26 opens into the enclosure 10. If the steam generator 25 is positioned at a distance from the enclosure 10, the steam generator 25 may comprise a steam hose or the like having the steam opening 26 at a free end.

In general, according to the present invention, the garments 20 are pre-moistened in the enclosure 10, and then treated further outside the enclosure 10. In the case of a garment de-wrinkling device according to the present invention comprising a dry iron 30, steam is formed during the ironing process as a result of contact between the hot iron 30 and the moistened garment 20. If the ironing board 40 of the garment de-wrinkling device is permeable to steam and is positioned on top of the enclosure 10, steam is supplied to the enclosure 10 during the ironing process. Thus, as the garments 20 have been pre-moistened, the use of a dry iron suffices, as steam is being to the enclosure 10.

A garment de-wrinkling device having an enclosure 10 for moistening garments 20 was described above. In a first preferred embodiment, an ironing board 40 and an adjacent standby area 41, which are both permeable to steam, are arranged on top of the enclosure 10.

During operation of the garment de-wrinkling device 1 according to the first preferred embodiment, the ironing board 40 and a steam iron 30 are used to iron garments 20 which have first been moistened inside the enclosure 10. In the process, steam released by the iron 30 penetrates the garments 20 and enters the enclosure 10 through the ironing board 40. In this way, both the garments 20 on the ironing board 40 and those inside the enclosure 10 are treated by means of the steam released by the iron 30, and the steam is used in an efficient manner.

A pressed look is obtained in that the garments 20 are subjected to a moistening process and a subsequent steam ironing process.

A few important aspects of the present invention will be listed below.

According to a first important aspect, the garment treatment device according to the present invention comprises vaporizing means 38 for putting the moistening agent into a vaporized state, which vaporizing means 38 are located inside the garment moistening tool 30 of the garment treatment device.

According to a second important aspect, the garment treatment device according to the present invention comprises vaporizing means 25 for putting the moistening agent into a vaporized state, which vaporizing means 25 are located inside the garment holding enclosure 10, while the moistening agent supplying means of the garment treatment device preferably comprise a vapor opening 26 in the vaporizing means 25 for releasing moistening agent vapor inside the garment holding enclosure 10.

According to a third important aspect, the garment treatment device according to the present invention comprises an ironing board 40 for supporting the garments 20 located outside the garment holding enclosure 10. Preferably, the ironing board 40 comprises a hollow section 42 which opens into the garment holding enclosure 10, while preferably a fan 43 is located in the hollow section 42 of the ironing board 40 for generating an air flow in the direction of the garment holding enclosure 10.

According to a fourth important aspect, the garment treatment device according to the present invention comprises a standby area 41 for supporting the garment moistening tool 30, 35 when it is in a standby state, i.e. a state in which the at least one outlet 34 of the garment moistening tool 30, 35 is releasing moistening agent in another direction than towards the garments 20 located outside the garment holding enclosure 10, which standby area 41 is preferably located on top of the garment holding enclosure 10.

According to a fifth important aspect, the garment treatment device according to the present invention comprises a container 27 for containing a garment treatment liquid and injecting means for injecting the garment treatment liquid into a flow of moistening agent that is supplied to the garment holding enclosure 10.

According to a sixth important aspect, the garment treatment device according to the present invention comprises a container 28 for containing water and injecting means for injecting the water into a flow of moistening agent that is supplied to the garment holding enclosure 10.

The invention claimed is:

1. Device for treating garments, comprising:

a garment holding enclosure for receiving, enclosing, and moistening garments;

at least one garment moistening tool having at least one outlet for supplying a moistening agent to garments located outside the garment holding enclosure when the garment holding enclosure is in an enclosed configuration; and moistening agent supplying means for supplying the moistening agent to the garment holding enclosure.

2. Garment treatment device according to claim 1, comprising vaporizing means for putting the moistening agent into a vaporized state, wherein the garment moistening tool is arranged to deliver the vaporized moistening agent through the at least one outlet, wherein the moistening agent supplying means comprise the at least one outlet of the garment moistening tool, and wherein at least a portion of a casing of the garment holding enclosure is permeable to moistening agent vapor.

3. Garment treatment device according to claim 2, wherein the vaporizing means are located inside the garment moistening tool, wherein additional vaporizing means for putting the moistening agent into a vaporized state are provided, and wherein the moistening agent supplying means comprise a vapor opening in the additional vaporizing means for releasing moistening agent vapor inside the garment holding enclosure.

4. Garment treatment device according to claim 1, comprising an ironing board for supporting the garments located outside the garment holding enclosure, wherein the ironing board is located on top of the garment holding enclosure.

5. Garment treatment device according to claim 4, wherein at least a portion of the ironing board is permeable to moistening agent vapor.

6. Garment treatment device according claim 1, comprising a standby area for supporting the garment moistening tool when it is in a standby state, wherein the standby state is a state in which the at least one outlet of the garment moistening tool is releasing moistening agent in another direction than towards the garments located outside the garment holding enclosure, wherein at least a portion of the standby area is permeable to moistening agent vapor.

7. Device for the treatment of garments, comprising a garment holding enclosure for receiving, enclosing, and moistening garments; wherein at least a portion of a casing of the garment holding enclosure is permeable to moistening agent vapor; and at least one garment moistening tool located outside the garment holding enclosure when the garment holding enclosure is in an enclosed configuration.

8. Garment treatment device according to claim 7, wherein the garment steaming tool comprises at least one outlet for releasing moistening agent vapor, wherein at least a portion of the resting pad is permeable to the moistening agent vapor.

9. Method of treating garments, comprising the following successive steps:

a) moistening the garments inside a garment holding enclosure by supplying moistening agent to the garment holding enclosure;

b) ironing the garments by pressing the garments between an ironing board and an iron having a heatable sole plate when the garment holding enclosure is in an enclosed configuration, during which moistening agent is supplied to the garments; and c) placing the iron on a standby area when the iron is in a standby state.

10. Method according to claim 9, wherein the moistening agent supplied to a garment being treated according to step b) is further supplied to at least one other garment being treated according to step a).

11. Method according to claim 9, wherein the moistening agent is put into a vaporized state.

* * * * *